United States Patent [19]

Stueke

[11] Patent Number: 4,685,985

[45] Date of Patent: Aug. 11, 1987

[54] METHOD OF ENVELOPING METAL HOLLOWS WITH POLYETHYLENE

[75] Inventor: Walter Stueke, Ratingen, Fed. Rep. of Germany

[73] Assignee: Mannesmann AG, Duesseldorf, Fed. Rep. of Germany

[21] Appl. No.: 842,779

[22] Filed: Mar. 21, 1986

Related U.S. Application Data

[63] Continuation of Ser. No. 791,690, Oct. 28, 1985, abandoned, which is a continuation of Ser. No. 562,511, Dec. 16, 1983, abandoned.

[30] Foreign Application Priority Data

Dec. 20, 1982 [DE] Fed. Rep. of Germany ..... 3247512

[51] Int. Cl.[4] ..... B05D 1/06; B05D 1/24

[52] U.S. Cl. ..... 156/185; 427/27; 427/32; 427/185; 427/195; 427/407.1; 427/409; 427/410; 156/192

[58] Field of Search ..... 427/27, 32, 185, 195, 427/407.1, 409, 410; 156/192

[56] References Cited

U.S. PATENT DOCUMENTS

| | | | |
|---|---|---|---|
| 4,104,416 | 8/1978 | Parthasarathy | 427/32 |
| 4,211,595 | 7/1980 | Samour | 427/195 |
| 4,319,610 | 3/1982 | Eckner | 427/195 |

*Primary Examiner*—Richard Bueker

*Attorney, Agent, or Firm*—Ralf H. Siegemund

[57] ABSTRACT

The metal hollow is provided with a base layer of an epoxy resin being electrostatically applied upon which an ethylene copolymer powder is electrostatically applied possibly under particular inclusion of epoxy resin and possibly in several layers of varying relative consistency; after each powder application step, surface heating is applied to melt the respective powder; the final coating of polyethylene is either electrostatically applied or through suitable extrusion process. Particular grain size distribution and powder consistency patterns are suggested.

17 Claims, 4 Drawing Figures

METHOD OF ENVELOPING METAL HOLLOWS WITH POLYETHYLENE

This is a continuation of co-pending application Ser. No. 791,690 filed on Oct. 28, 1985, now abandoned, which is a continuation of Ser. No. 562,511 filed Dec. 16, 1983, now abandoned.

BACKGROUND OF THE INVENTION

The present invention relates to the layering, coating and enveloping of metal parts such as tubes, pipes or other hollows, with polyethylene.

Steel pipes which are to be deposited underground require some form of insulation. A three layer synthetic jacket was found particularly suitable here. The three layers are comprised, of an adhesion enhancing cured epoxy coating being applied directly upon the steel pipe; this layer in turn is covered by an adhesion made of an ethylene copolymer and the outer jacket consists of polyethylene. Such a three layer jacket is, for example, known through the German printed Pat. No. 19 65 802, the same reference describes also a method for applying such a jacket upon the steel pipe. Basically, the steel pipe is preheated to a temperature between 140° and 200° C. and an epoxy resin is sprayed upon the heated pipe, the epoxy layer will cure at that temperature. As the epoxy cures, an ethylene copolymer foil or ribon is extruded and wrapped around the epoxy layer as it cures. This ethylene copolymer ribbon consitutes the adhesive proper for a polyethylene ribbon which is likewise extruded and wrapped around the adhesion carrying pipe.

This known method is not economical particularly for jacketing short tubular pieces because the composite motion various parts have to undergo during the wrapping process is quite complex. Moreover, the steel pipe may already carry on its inside a heat sensitive coating. Therefore, preheating the steel pipe for purposes of permitting the epoxy to cure may be prohibited.

German printed Pat. No. 22 22 911 describes a jacketing procedure for enveloping metal tubes with a three layer jacket under the assumption that the tube carries already a heat sensitive interior coating. The tube in this case is heated to only 70° to 90° C. whereupon the epoxy layer is applied. The ethylene copolymer adhesive and the outer layer material, i.e. the polyethylene, are extruded as a kind of twin hose and applied in that configuration upon the epoxy layer. The heat content of the twin hose is insufficient to provide a speedy curing of the epoxy but curing will be obtained at room temperature within about 24 hours. However, this method is likewise uneconomical or possibly even inapplicable in cases in which the hollow deviates from a cylinorical contour. Also, the rather long curing period is detrimental because of the storage requirement.

German Pat. No. 22 56 135 suggests preheating a steel pipe to 80° C. prior to jacketing whereupon a epoxy resin-curing agent blend in a particular solution is electrostatically applied to that steel pipe for obtaining a coating, for example, on the order of 100 micrometers. The ethylene copolymer layer and the outer polyethylene layer are then applied together either through stretch application of an extruded twin hose or by wrapping the epoxy coated layer in extruded ribbons of the two materials. Following cooling of the jacketed pipe to a medium temperature of about 40° C., the surface of the steel pipe is inductively heated to about 200° C. resulting in an average temperature in the pipe of about 100° C. This then permits curing of the epoxy layer within a few seconds while the interior of the pipe is comparatively little affected. Again, it has to be said that in view of the particular mode of applying the ethylene copolymer as well as the polyethylene layer, one cannot jacket noncylindrical tubular objects in this fashion.

An important feature with regard to quality of a synthetic coating or jacket is the peel strength thereof. The peel strength of a multilayer synthetic coating is to some extent detrimentally affected by interior stress and by the inherent discontinuities between the several layers. Peel tests on steel pipes which have been layered in accordance with the aforementioned methods usually exhibit a separation in the transition region, i.e. the interface zones of the several synthetic layers. The bond between the epoxy base coating and the steel pipe is usually by far the strongest. The relative peel strength as between the two thermoplastic layers, i.e. the ethylene copolymer adhesive and the outer polyethylene jacket is likewise comparatively high and can be controlled through a suitable selection of the operating and process parameters such as the temperature development. However, the peel strength is critical in the transition zone between the epoxy layer and the ethylene copolymer adhesive.

DESCRIPTION OF THE INVENTION

It is an object of the present invention to provide a new and improved method for coating and jacketing tubular objects such as regular tubes as well as hollows of a complex contour and construction under conditions which will not raise the temperature of the inner surface of such a hollow or tube to a significant degree so as to particularly avoid endangering any internal jacket or coating the hollow or tube may already carry.

It is a particular object of the present invention to provide a jacket for hollow objects such as tubes and other tubular and hollow shapes under utilization of an epoxy based inner jacket or coating, an adhesive made of an ethylene copolymer and an outer, polyethylene jacket under conditions which permit avoidance of excessive heating of the object to be jacketed, while the peel strength of the envelope as a whole as well as of its components is sufficiently high.

In accordance with the preferred embodiment of the present invention it is suggested to preheat the hollow to a temperature of at least 80° C. but to a temperature which, if necessary, will remain below any value that may endanger any interior coating the hollow may already possess. The primary or initial coating is prepared as an epoxy-curing agent blend in the form of a precondensated powder and will cure at a temperature between 145° and 155° C. between 50 and 70 minutes. This blend is electrostatically deposited upon the surface of the hollow at a layer thickness from 30 to 50 micrometers. Heat is applied externally to heat this coating to a temperature somewhat above 150° C. until curing has sufficiently progressed and the resulting chemical reaction products have evaporated. Thereafter, but still concurrently with the curing of the epoxy layer, predried ethylene copolymer powder is electrostatically applied to the epoxy layer in one or several coatings with a total layer thickness of at least 150 micrometers whereby following each such spray-on step the temperature of the newly created layer is increased to 180° and above for melting the powder layer; polyethylene is applied upon the heated ethylene copolymer layer in one of the following manners; either polyethylene powder is electrostatically sprayed on for a layer thickness of at least 1.8 mm, following which the layer temperature is raised to a value between 180° and 220° C. for melting the applied powder; alternatively, a hose or a wrap-on ribbon is extruded and applied upon the tube; in the final step the coated hollow is cooled to room temperature.

The inventive method has the advantage that irrespective of any complexity in the contour of the hollow, all portions thereof can be coated with the same, i.e. a uniformly high quality insulative coating. Moreover, a complete tube or pipe system can be uniformly coated and enveloped in this fashion. Previously, certain shapes such as bent sleeves, T-shaped hollows or the like, had to be coated in a manner different from the coating commonly provided to straight and smooth pipes, for example, by means of wrapping the more complex shapes in a bituminous or synthetic wrapping, particularly after installation of the pipe and conduit system. Consequently, the protection of various components in the completed pipeline differed. Contrary thereto the uniform coating in accordance with the inventive method is no longer endangered as a result from any lack is uniformity alone. For example, the formation of pits on account of corrosion induced by electric currents in the surrounding soil or any internal migration of moisture into and through the insulation will no longer occur primarily because the insulation will adhere sufficiently strongly to the tube so that such migration of moisure does not have to be expected. The same is true as far as the bond between the several layers in the envelope is concerned.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection wiht the accompanying drawings in which:

Before proceeding to the detailed description of the drawings, it is pointed out that the various layer thicknesses referred to the in the following do not refer to the layers as applied in powdery consistancy but after the respective layer portion and insulation has melted and solidified.

Figure 1:
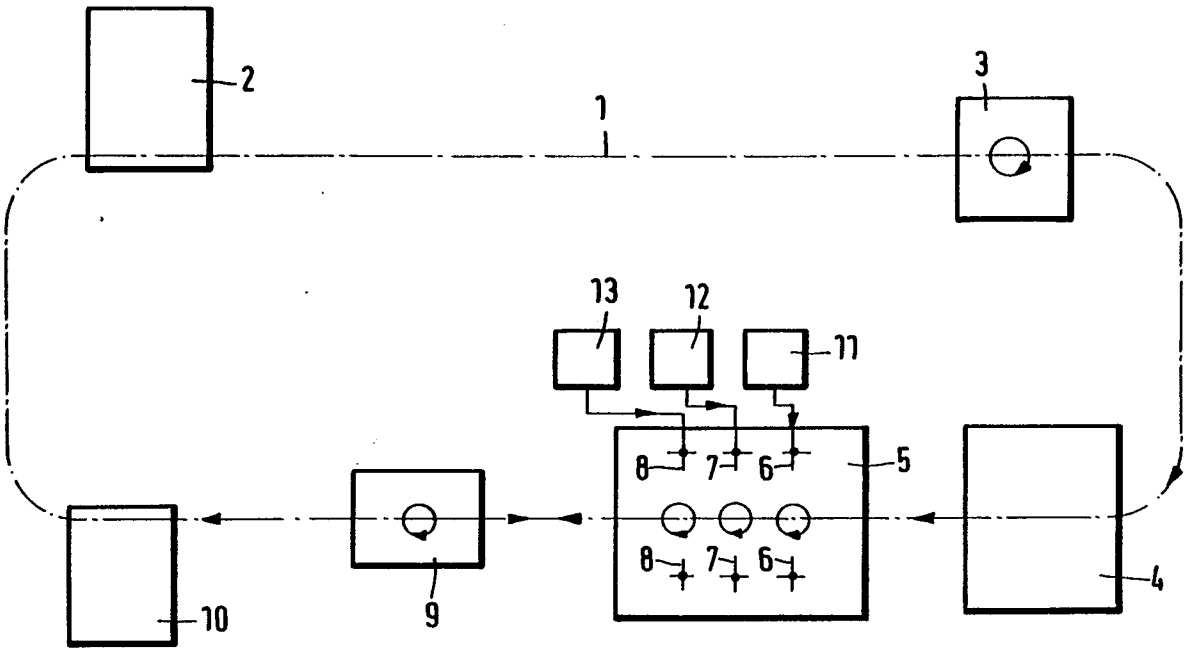
FIG. 1 is a schematic process diagram to demonstrate the coating procedure for a hollow shape, however, under utilization of just an ethylene copolymer bonding layer.
Figure 3:
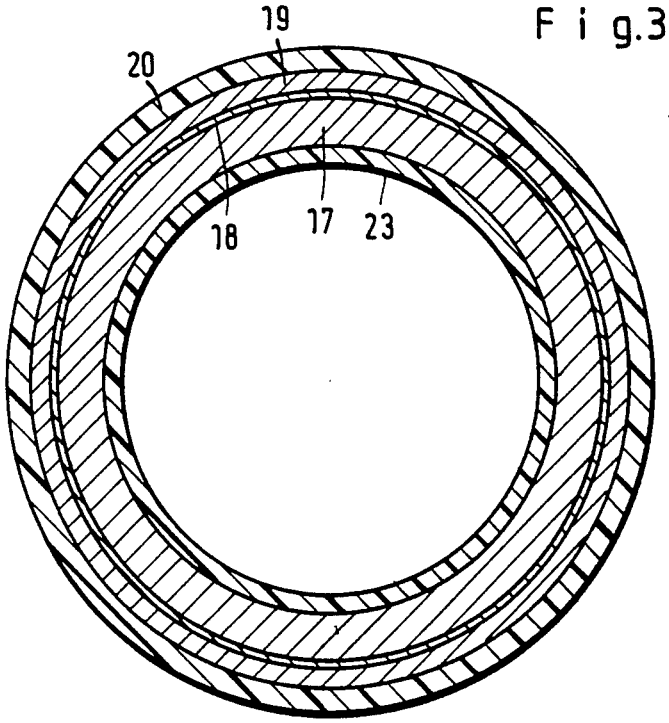
FIG. 3 is a section through an insulation as provided in accordance with the method explained with reference to FIG. 1.

Proceeding now to the detailed description of the drawings, FIG. 1 and 3 refer to the layering of the surface of a T-shaped steel hollow 17 being 2.5 m long, 1.5 m wide with a diameter of 150 mm. This steel piece 17 is assumed to carry an internal coating 23 made, for example, of bituminous material, cement mortar or a synthetic, being therefore sensitive to high temperatures accordingly. This piece is moved through a system of stations by means of a suitable endless transport facility 1 such as an overhung trolley vehicle arrangement or the like, particularly a store 2 is provided along the track, and the transport facility moves the respective pieces to a device or station 3.

Station 3 is a cleaning station generally and may include the steel wire spray device spraying the piece with steel granules for cleaning the surface thereof. The hollow piece 17 is continued towards a station 4 being a hot air furnace for heating the piece 17 to 90° C. The various circular arrows in the Figure indicate that the piece 17 is rotated while being in the respective station. The preheated piece 17 is next fed to a enclosure 5 in which an epoxy curing agent blend is sprayed by means of spray guns 6 upon the surface of the piece 17. The epoxy curing agent blend has about room temperature and is a precondensate powder amenable to curing within 50 to 70 minutes at a temperature between 145° and 155° C. The sprayed on coating being electrostatically applied will have a thickness from 30 to 50 micrometers subject to the conditions mentioned above. The epoxy-curing agent powder blend is fed to the spray guns 6 from a suitable storage container 11. As the powder is applied to the preheated piece 17, it melts but will not flow and the resulting coating is not necessarily coherent.

In other words the fluidity attained is insufficient to cause the melted material to more or less freely flow over the surface of the piece 17. In order to provide a coherent base layer 18, the coated piece 17 carrying the electrostatically applied epoxy layer is moved to an infra-red radiation station 9 wherein through infra-red radiation the epoxy layer 18 only is heated for 10 seconds, the heating raising the temperature of the coating to 200° C. This method insures that the temperature of the steel body 17 is hardly raised at all.

Curing of the epoxy layer 18 has now commenced. It did commence already during the spraying to some extent but will be enhanced significantly by the application of infra-red radiation. Prior to completing of the curing, the piece 17 is returned to the coating facility 5 as indicated by the double arrow between the stations 5 and 9. Approximately 30 seconds after the epoxy layer 18 has been applied spray gun 7 will apply an ethylene copolymer powder upon the layer 18 at a layer thickness of 150 micrometer. The layer 18 upon which the ethylene copolymer powder is applied will have a temperature from 160° to 170° C. at least during the beginning of this spray-on operation.

The powder now applied should have a grain size distribution as follows: about 70% should be 30 micrometer; 20% should be 20 micrometer; and 10% should be 10 micrometer; the dimension referring, of course to grain size of the ethylene copolymer adhesive powder. This powder is applied to the spray gun 7 from a storage bin or other facility 12 either in this facility 12 or elsewhere the powder was predried for 1½ hours at 70° C.

While the epoxy layer 18 and the ethylene copolymer layer 19 bond intimately already during the application of the powder, the workpiece 17 is again moved back to the infra-red station 9 wherein infra-red radiation of one minute duration is applied for heating the ethylene coopolymer layer 19 to 180° C. so that the material will melt and will be smoothed within five minutes.

Infra-red heating is not the only method by means of which thermal energy can be provided. One may, for example, use a microwave heating process. Following the heating in station 9, the partially coated hollow piece 17 is again returned to the coating facility 5 and now polyethylene 20 is electrostatically applied as a powder by means of spray guns 8 using the storage facility 13 for supplying polyethylene powder to the gun. The coating is again electrostatically carried out to obtain a layer thickness of 1.8 mm. Following the spray-on of polyethylene, the piece 17 is again returned to the infra-red station 9 wherein infra-red radiation is applied for 30 minutes to raise the temperature and maintain the temperature of the polyethylene layer from 180° to 200° C.

In lieu of infra-red radiation as stated, microwave radiation can be used; decisive is that the temperature of the steel piece 17 itself will not be raised above 100° C. During the heating, particularly during the last heating stage, the epoxy layer 18 will cure completely. Finally, the T-shaped piece with its three layer coating is removed from the heating station 9 for cooling down to room temperature and reference numeral 10 refers to the final storage facility in which the coated piece is stored until used further.

Figure 2:
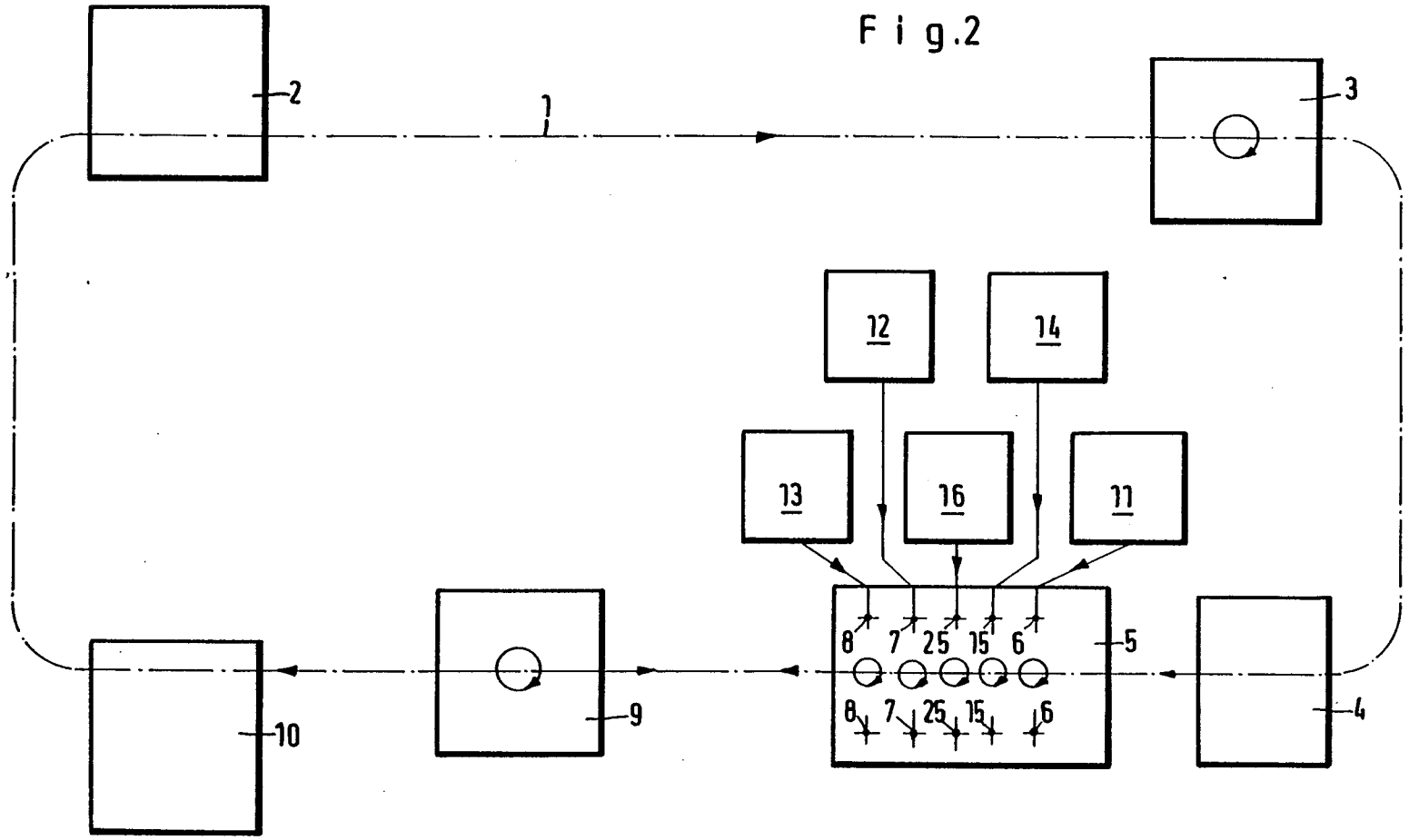
FIG. 2 is a process diagram for providing an insulation on a hollow under utilization of a three layer adhesive coating.
Figure 4:
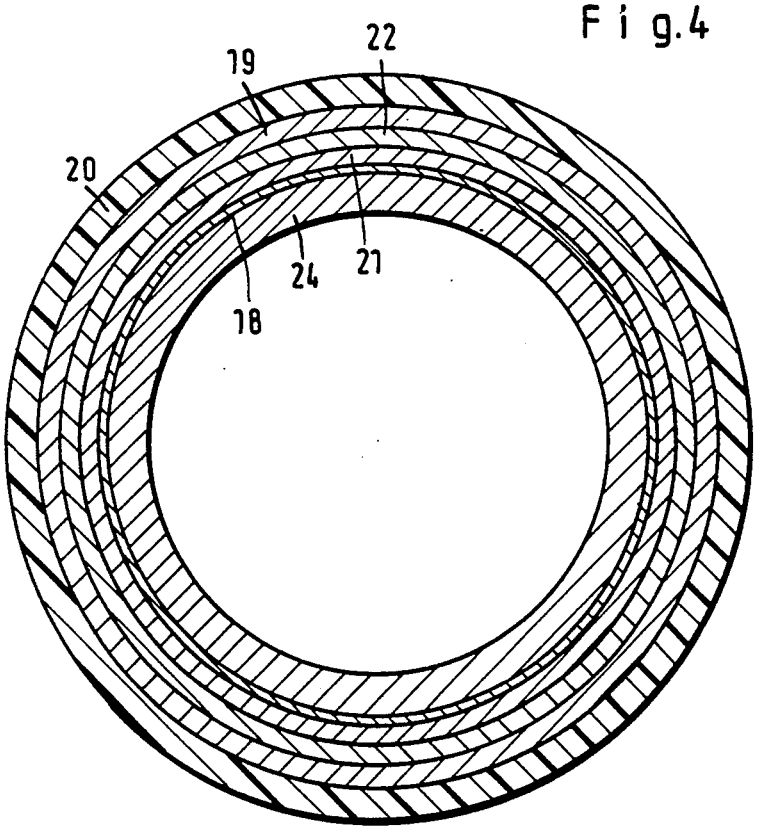
FIG. 4 is a cross section through the insulation of a hollow produced in accordance with the method explained with reference to FIG. 2.

Proceeding now to the description of the example shown in FIG. 2 and FIG. 4, a 90° bent steel sleeve 24 of 180 mm diameter and a leg length of 1,000 mm is to be coated. Many aspects of the coating procedure are the same as described with reference to FIG. 1 so that the description of FIG. 2 and 4 can be restricted to an emphasis on differences. Most importantly, the cleaning in station 3 and preheating in station 4 is the same. Also, various spray-guns are used in an analogous fashion. However, the piece 24 does not carry a heat sensitive internal layer so that the preheating in this hot air furnace 4 may raise the temperature of the piece 24 to at least 150° C. This higher operating temperature reduces the periods of time in between the several process steps and, of course, reduces particularly the time for curing the epoxy layer 18. After the epoxy layer 18 has been applied and melted, generally as stated above, the bonding agent and adhesive will be applied in three coating steps in the following manner.

The coating facility 5 includes spray guns 15 being fed with powder from storage facility 14 in which ethylene copolymer powder was predried at 100° C. The guns 15 provide electrostatically a coating of 75 micrometer thickness. However, the powder particles do not exclusively consist of ethylene copolymer, rather the grains each have a copolymer core of about 50 micrometer maximum diameter being coated with the same kind of epoxy curing agent blend, in shell-like configuration at a thickness from 10 to 20 micrometers. Consequently, this powder consists actually predominantly of epoxy-curing agent blend.

Due to the preheating of this powder in the storage facility 14, a certain reaction begins already prior to the electrostatic application and involving the various components of the granules whereby particularly various components in each granule begin to become intimately bonded.

After this particular layer 21 has been applied upon the base coating 18, the piece 24 is moved to the infra-red station 9 wherein radiation is applied for 20 seconds heating the layer 21 to 180° C. for melting the powder particles.

Subsequently, the piece 24 is returned to the coating station 5 and another powder layer 22 is applied by means of spray guns 25 using powder particles from a container 16. The depositing is again carried out electrostatically and ultimately the thickness will be 75 micrometer. The powder, however, has a reverse consistency by means of which the coating 21 was produced. In other words, the powder in container 16 consists of particles with a core of about 50 micrometer diameter and made of epoxy curing agent blend and such core is surrounded by a shell of 10 to 20 micrometer thickness made of predried ethylene copolymer.

Following the application of this powder layer, the piece 24 is again returned to the infra-red station 9 wherein for 20 seconds radiation is applied to melt the layer 22 at about 180° C. Subsequently, the piece 24 is returned to this station 5 and the spray guns 7 using the content of container 12 provide the third bonding agent layer 19 now being comprised of pure ethylene copolymer powder, the electrostatically produced layer thickness being 150 micrometers. The piece is returned to the infra-red station 9 for melting this layer in one minute in a manner described above.

The coating procedure is continued as in the first example by applying a 1.8 mm thick layer 20 of polyethylene powder upon the bonding agent three ply layer following which heating is carried out for 30 minutes in the station 9 at a temperature from 180° to 200° C. Thereafter the piece with its coating is cooled in air. Differing from the first example, one may use other heat sources because the temperature of the steel pipe is no longer critical if the piece does not carry an internal heat sensitive layer. Therefore, other external heat sources such as hot air or combinations of hot air and infra-red radiation can be applied. However, it must be observed that the temporal sequence has to follow the rules outline above for reasons of the temperature transfer conditions between the several layers during the procedure.

For layering and coating smooth, straight tubes a continuous procedure can be followed in lieu of the discontinuous procedure outline above with regard to individual hollow shapes. It is merely necessary to provide the requisite stations in a series or sequence along the path of transport of such tubing. Due to the simple surface geometry in the case of smooth straight tubes, the polyethylene layer does not have to be electrostatically applied but one can use extrusion of a hose or wrapping of extruded polyethylene foil upon the coated tube. Also, air cooling is not necessary but for speeding up the procedure one can use a water cooling bath or spray water for the respective cooling procedure.

In the coating and enveloping procedure as described with reference to the hollow 17 in the first example, one obtains a three layer insulation as illustrated in FIG. 3. By virtue of the particular grain distribution of the adhesive powder, one obtains an intimate bond between the epoxy layer 18 and the bonding agent 19. This effect results from the electrostatic field effecting predominantly powder particles of smallest diameter so that the smallest grains accumulate in a preferred distribution in the immediate vicinity of the epoxy layer 18. Therefore, these small particles will react faster with the epoxy layer for obtaining a bond than the larger particles.

It was mentioned above that the bonding agent being comprised of an ethylene copolymer should have a certain grain size distribution. In leiu of that distribution, one may use a bonding agent which is a blend of a ethylene copolymer powder and a powdery, epoxy-curing agent blend, the latter amounting to at least 30% but not more than 50% in the overall blend, the percentage being understood to be by weight. In this case, one actually obtains a still more favorable bonding condition as between the duroplastic (thermosetting) epoxy layer and the thermoplastic bonding agent because the epoxy powder particles will preferedly be deposited on the surface of the base layer when exposed to the electrostatic depositing field. Moreover, the specific weight of the ethylene copolymer results in the tendency that the epoxy layer particles when melting will sink towards the epoxy layer coating that was applied earlier. Thus, one obtains a graduated, diffusion pattern like transition between the different materials, i.e. between the epoxy layer and the ethylene copolymer layer.

The coating, in accordance with FIG. 4, is still more favorable as it results, from an overall point of view in a five layer configuration. The various laminae 21, 22 and 19 fo the bonding agent being disposed in effect between the epoxy base layer 18 and the polyethylene cover 20 in effect produce a still more uniform and gradual transition from the duroplastic (thermosetting) material, i.e. the epoxy layer, within the thermoplastic region defined by the ethylene copolymer materials. Again, the difference in specific weight in ethylene copolymer on the one hand and epoxy resins on the other hand is effective during the melting of the sequentially deposited layers 21, 22 and 19 in order to obtain a smoother transition between the various materials within and between the partial layers 21, 22 and 19.

The improvements resulting from application and utilization of the inventive method as compared with the prior art as it relates to the coating and enveloping of steel pipe can be more vividly understood from the following numerical data.

The state of the art as far as coating of steel pipes are concerned and as was outlined in the introduction, produces a peel strength in Newtons of 35 per centimeter at 20° C. If a boiling test at 65° C. was added, and the test was applied after 30 days, again at 20°, the peel strength had dropped to 20 Newtons per centimeter and may be as low as 0. The disbonding characteristics at AFTM conditions in millimeter was about 8 to 30.

For these three different conditions a different result is obtained if the bonding agent has a grain size distribution of 70%/20%/10% for a 30/20/10 micrometer grain size pattern. These figures then are respectively 40 to 50 N/cm peel strength at 20° C.; 10 to 20 N/cm (with boiling test) and 4 to 6 disbonding in millimeter.

If the bonding agent is comprised of an ethylene copolymer powder with at least 30% epoxy-curing agent powder blended thereto the following data are observed: 50 to 70 N/cm regular peel strength; 10 to 30 N/cm (with boiling test) and disbonding under ASTM conditions of 3 to 5 millimeter.

If a three layer configuration bonding agent is chosen (FIG. 4) with a powder distribution outlined above wherein the powder particles themselves differ, the normal peel strength increases to 130 to 170 Newtons per centimeter. With boiling test added, the peel strength was still 35 to 85 Newtons per centimeter and the disbonding under ASTM conditions in millimeter dropped from 0 to 2. In all cases a copolymer of ethylene containing acrylic acid and its ester was used as adhesive. The epoxy-curing agent blend consists of enichloronycirin and an amin (as curing agent).

The invention is not limited to the embodiments described above but all changes and modifications thereof not constituting departures from the spirit and scope of the invention are intended to be included.

I claim:

1. Method of enveloping hollow objects having a temperature sensitive internal coating comprising the steps of heating the hollow object to a temperature of at least 80 degrees C. but well below a critical temperature of the sensitive coating;

providing a powder of an epoxy resin-curing agent blend being amendable to curing within 50 to 70 minutes at a temperature of 145 degrees to 155 degrees C.;

electrostatically applying the powder as precondensate powder coating upon the surface of the hollow object at a layer thickness from 30 to 50 micrometers;

applying externally heat to the powder coating for heating the powder coating to a temperature above 150 degrees C. until chemical reaction products have escaped;

providing a bonding layer that includes an ethylene copolymer, onto said epoxy layer and at a total layer thickness of at least 150 micrometers said bonding layer being applied as one or more coating layers, wherein each coating layer is applied to a thickness of at least 75 micrometers, and said step of providing a bonding layer including applying electrostatically a blend of a predried ethylene copolymer powder and of a powder of the epoxy resin-curing agent mixture, the epoxy resin-curing agent blend amounting to at least 30% of the mixture, melting through external application of heat, each of these ethylene copolymer layers at a temperature of at least 180 degrees C.;

applying a polythylene layer upon the heated ethylene copolymer layer;

cooling the resulting composite hollow object to room temperature; and each of the heating steps being of such duration and such limited temperature that the internal portions of the hollow object will remain at temperatures well below said critical temperature of said temperature sensitive coating.

2. Method as in claim 1 wherein said polyethylene is electrostatically applied as powder to obtain a layer thickness of at least 1.8 mm, following which the polyethylene is heated at a temperature between 180° and 200° C.

3. Method as in claim 1 wherein said polyethylene is applied by extruding a polyethylene hose upon the ethylene copolymer layer.

4. Method as in claim 1 wherein said polyethylene is applied as extruded, wrapped around ribbon.

5. Method as in claim 1 wherein said ethylene copolymer powder has a grain size distribution of about 70% 30 micrometer grain size, 20% 20 micrometer grain size and 10% 10 micrometer grain size.

6. Method as in claim 1 wherein said ethylene copolymer powder is heated to 100° and applied in multiple layers at a thickness of at least 75 micrometers for one layer wherein said ethylene copolymer powder particles in said one layer each have a shell of the epoxy-resin curing agent blend.

7. Method as in claim 1 wherein said ethylene copolymer powder is heated to 100° C. and applied at a thickness of at least 75 micrometers for one layer wherein the powder particles in said one layer have a core of the epoxy resin-curing agent blend, each particle having a shell of said ethylene copolymer.

8. Method as in claim 1 wherein the powder applied in the epoxy-curing agent coating is made of particles having a core of about 50 micrometer diameter and a shell from 10 to 20 micrometer, some of the cores in the shell being the ethylene copolymer, and others of the cores in the shell being the epoxy resin-curing agent.

9. Method as in claim 1 wherein said heating step applied to the epoxy resin-curing agent powder layer heats that layer to a temperature between 190° and 210° C.

10. Method as in claim 1 wherein at least some of the heating steps are applied through infra-red or microwave radiation.

11. Method as in claim 1 wherein at least some of the heating steps include heating through hot air.

12. Method as in claim 1 wherein said ethylene copolymer powder is predried for 1½ hours at 70° C.

13. Method as in claim 1 wherein said hollow object is preheated to a temperature of not more than 100° C.

14. Method as in claim 1 wherein said hollow object is not provided with a temperature sensitive internal coating, said hollow object being preheated to a temperature of not more than 200° C.

15. Method as in claim 1 wherein following said formation of the epoxy layer but prior to the application of polyethylene the following sequence of steps is provided to obtain said bonding layer:

a first layer is deposited by utilization of a powder wherein the particles have an ethylene copolymer core and an epoxy-curing agent shell, the resulting layer being about 75 micrometers;

subsequently a powder is applied, the particles having an epoxy resin-curing agent core and an ethylene copolymer shell, the layer being about 75 micrometers; and pure ethylene copolymer powder is applied at a layer thickness of not more than 150 micrometer thickness.

16. Method of enveloping hollow objects comprising a steps of heating the hollow object to a temperature of at least 80 degrees C., but not more than 200 degrees C.;

providing a powder of an epoxy resin curing agent blend being amenable to curing within 50 to 70 minutes at a temperature 145 degrees to 155 degrees C.;

electrostatically applying the powder as a precondensate powder coating upon the surface of the hollow object at a layer thickness from 30 to 50 micrometers;

applying externally heat to the powder coating for heating the powder coating to a temperature above 150 degrees C. until chemical reaction products have escaped;

applying electrostatistically an ethylene copolymer containing layer comprising a mixture of a predried ethylene copolymer powder and the epoxy resin-curing agent blend, the latter amounting to at least 30% of the mixture, said powder being applied in one or more layers said ethylene copolymer containing layer being deposited to a total layer thickness of at least 150 micrometers;

said ethylene copolymer powder having a grain size distribution of about 70% 30 micrometer grain size, 20% 20 micrometer grain size and 10% 10 micrometer grain size;

melting through external application of heat, each coating at a temperature of at least 180 degrees C.;

applying a polyethylene layer upon the heated ethylene copolymer containing layer; and cooling the resulting composite hollow object to room temperature.

17. Method as in claim 16 wherein said hollow object is first preheated to 170° C. and immediately prior to the first powder application step by means of infra-red radiation to 200° C.

* * * * *

UNITED STATES PATENT AND TRADEMARK OFFICE

CERTIFICATE OF CORRECTION

PATENT NO. : 4,685,985

DATED : August 11, 1987

INVENTOR(S) : Walter Stucke

It is certified that error appears in the above-identified patent and that said Letters Patent is hereby corrected as shown below:

On the Title Page, Item [19] "Stueke" should read -- Stucke --
Item [75] "Walter Stueke" should read
-- Walter Stucke --.

Signed and Sealed this

Eighth Day of November, 1988

*Attest:*

DONALD J. QUIGG

*Attesting Officer*

*Commissioner of Patents and Trademarks*